US011776733B2

(12) United States Patent
Yoshikawa

(10) Patent No.: US 11,776,733 B2
(45) Date of Patent: Oct. 3, 2023

(54) REACTOR INCLUDING A MAGNETIC CORE

(71) Applicants: AutoNetworks Technologies, Ltd., Yokkaichi (JP); Sumitomo Wiring Systems, Ltd., Yokkaichi (JP); Sumitomo Electric Industries, Ltd., Osaka (JP)

(72) Inventor: Kohei Yoshikawa, Yokkaichi (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 413 days.

(21) Appl. No.: 17/263,427

(22) PCT Filed: Aug. 1, 2019

(86) PCT No.: PCT/JP2019/030180
§ 371 (c)(1),
(2) Date: Jan. 26, 2021

(87) PCT Pub. No.: WO2020/031832
PCT Pub. Date: Feb. 13, 2020

(65) Prior Publication Data

US 2021/0159009 A1 May 27, 2021

(30) Foreign Application Priority Data

Aug. 9, 2018 (JP) ..... 2018-150908

(51) Int. Cl.
*H01F 27/26* (2006.01)
*H01F 27/06* (2006.01)
(Continued)

(52) U.S. Cl.
CPC ..... *H01F 27/266* (2013.01); *H01F 27/06* (2013.01); *H01F 37/00* (2013.01); *H01F 2027/2857* (2013.01)

(58) Field of Classification Search
CPC ..... H01F 27/266; H01F 27/06; H01F 37/00; H01F 2027/2857; H01F 27/263; H01F 27/255; H01F 27/306
See application file for complete search history.

(56) References Cited

U.S. PATENT DOCUMENTS

2011/0102121 A1 5/2011 Otsuka et al.

FOREIGN PATENT DOCUMENTS

| | | | |
|---|---|---|---|
| JP | S61-20007 U | | 2/1986 |
| JP | 2004039847 A | * | 2/2004 |
| JP | 3195212 U | | 1/2015 |

OTHER PUBLICATIONS

International Search Report, Application No. PCT/JP2019/030180, dated Oct. 1, 2019. ISA/Japan Patent Office.

* cited by examiner

*Primary Examiner* — Tuyen T Nguyen
(74) *Attorney, Agent, or Firm* — Honigman LLP

(57) ABSTRACT

A reactor including a magnetic core and a coil having a wound part, the magnetic core having an inner core part disposed inside the wound part and an outer core part disposed outside the wound part, is provided with a bolt coupling the inner core part and the outer core part, the bolt being constituted by a composite material formed by dispersing a soft magnetic powder in a resin and including a shaft part passing through the outer core part, the shaft part including a tip reaching the inner core part, and the inner core part and the outer core part respectively being an integrated member having an undivided structure.

9 Claims, 5 Drawing Sheets

(51) Int. Cl.
*H01F 37/00* (2006.01)
*H01F 27/28* (2006.01)

REACTOR INCLUDING A MAGNETIC CORE

CROSS-REFERENCE TO RELATED APPLICATIONS

This application is the U.S. national stage of PCT/JP2019/030180 filed on Aug. 1, 2019, which claims priority of Japanese Patent Application No. JP 2018-150908 filed on Aug. 9, 2018, the contents of which are incorporated herein.

TECHNICAL FIELD

The present disclosure relates to a reactor.

BACKGROUND

For example, Japanese Utility Model Registration No. 3,195,212 discloses a reactor that is provided with a coil having a wound part formed by winding a winding wire and a magnetic core forming a closed magnetic circuit. The magnetic core of this reactor can be divided into an inner core part disposed inside the wound part and an outer core part disposed outside the wound part. In Japanese Utility Model Registration No. 3,195,212, the magnetic core is formed by a core piece forming the outer core part being coupled with a bolt member to an inner core part formed by assembling a plurality of mutually independent core parts (core pieces) together with a gap member.

According to the configuration of Japanese Utility Model Registration No. 3,195,212, a plurality of core pieces can be precisely coupled. Also, the bolt member coupling the core pieces is disposed to pass through all the core pieces, and does not jut out on the outer side of the coil, thus enabling enlargement of the reactor due to the bolt member to be suppressed. However, the configuration of Japanese Utility Model Registration No. 3,195,212 has room for improvement in terms of productivity, and, moreover, there is also the possibility of deterioration in the magnetic characteristics.

Firstly, since the inner core part is constituted by a plurality of core pieces and a gap member, a through hole has to be provided in each core piece and the gap member. Also, tasks such as positioning the core pieces and the gap member and aligning the through holes of the various members and passing the bolt member therethrough are troublesome.

Secondly, in the configuration of Japanese Utility Model Registration No. 3,195,212, the bolt member is disposed in a portion that serves as a magnetic circuit and the magnetic characteristics of the reactor are poor. This is because the material of the bolt member of Japanese Utility Model Registration No. 3,195,212 was selected in consideration of the clamping strength of the bolt member, and the magnetic characteristics of the reactor were not taken into consideration in selecting the material.

In view of this, one object of the present disclosure is to provide a reactor that has excellent magnetic characteristics and can be productively manufactured with a simple procedure.

SUMMARY

A reactor of the present disclosure is a reactor including a magnetic core and a coil having a wound part, the magnetic core includes an inner core part disposed inside the wound part and an outer core part disposed outside the wound part. The reactor is provided with a bolt coupling the inner core part and the outer core part. The bolt is constituted by a composite material formed by dispersing a soft magnetic powder in a resin, and includes a shaft part passing through the outer core part. The shaft part includes a tip reaching the inner core part. The inner core part and the outer core part are an integrated member having an undivided structure.

Advantageous Effects of Disclosure

A reactor of the present disclosure has excellent magnetic characteristics and can be productively manufactured with a simple procedure.

DETAILED DESCRIPTION OF PREFERRED EMBODIMENTS

Figure 1:
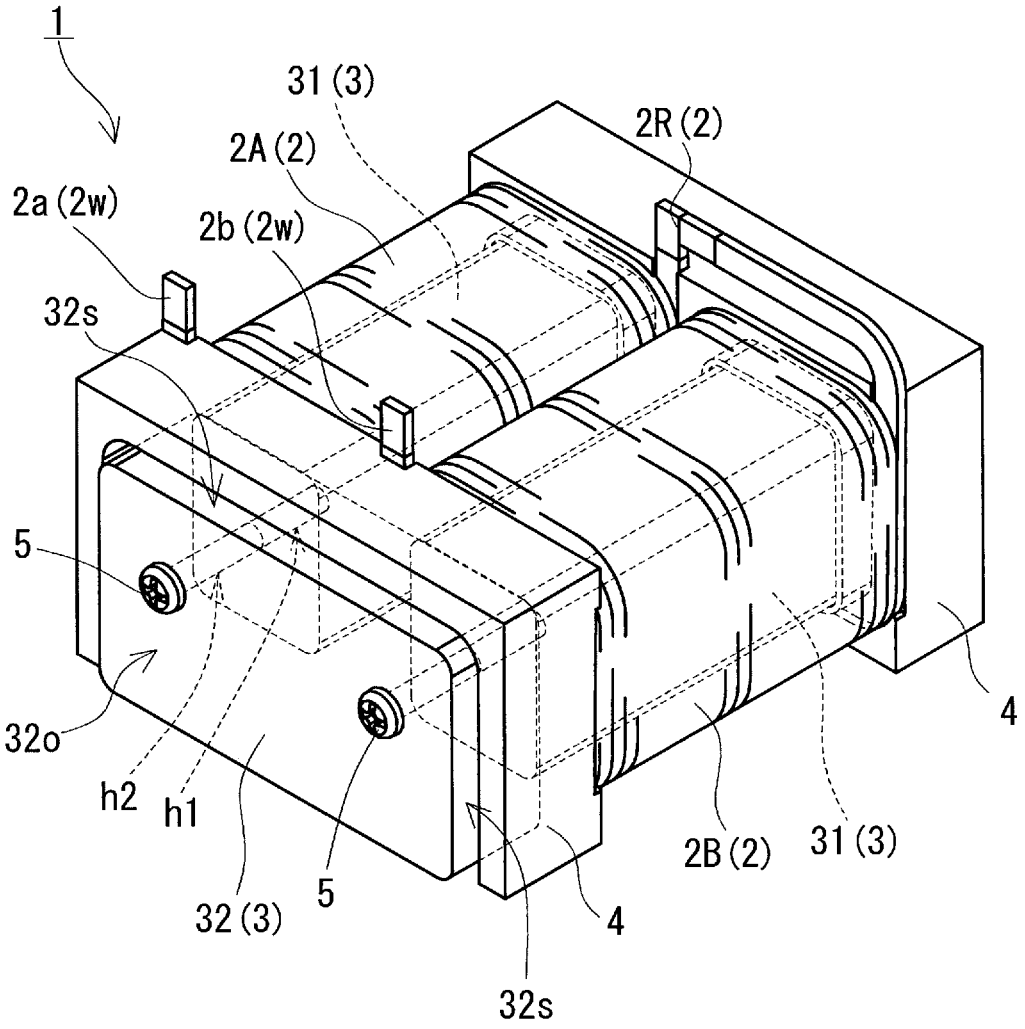
FIG. 1 is a perspective view of a reactor of Embodiment 1.

Embodiments of the present disclosure will initially be enumerated and described.

A reactor according to an embodiment includes a magnetic core and a coil having a wound part, the magnetic core having an inner core part disposed inside the wound part and an outer core part disposed outside the wound part. The reactor is provided with a bolt coupling the inner core part and the outer core part. The bolt is constituted by a composite material formed by dispersing a soft magnetic powder in a resin, and includes a shaft part passing through the outer core part. The shaft part includes a tip reaching the inner core part. The inner core part and the outer core part respectively being an integrated member having an undivided structure.

The reactor of the above configuration can be productively manufactured. This is because the inner core part and the outer core part are both integrated members having an undivided structure, and thus the number of members that need positioning at the time of coupling with the bolt will be two. For example, in the case of a magnetic core in which a pair of inner core parts and a pair of outer core parts are annularly joined, bolt fastening will be carried out a total of four times, when coupling one of the outer core parts to one of the inner core parts, when coupling the one outer core part to the other inner core part, when coupling the other outer core part to the one inner core part, and when coupling the other outer core part to the other inner core part. At the time of each bolt fastening, one inner core part and one outer core part need only be positioned.

Also, in the reactor of the above configuration, a deterioration in the magnetic characteristics that are required in the reactor is unlikely to occur. This is because the bolt coupling the inner core part and the outer core part is constituted by a composite material, and thus a deterioration in the magnetic characteristics that are required in the magnetic core of the reactor is suppressed.

As one mode of the reactor according to the embodiment, the inner core part can have a first bolt hole of a predetermined depth extending in an axial direction of the inner core part from an end face thereof, the outer core part can have a second bolt hole extending coaxially with the first bolt hole and passing through the outer core part, and the inner peripheral surface of the first bolt hole can be provided with a female thread portion corresponding to a male thread portion of the bolt.

By forming a female thread portion in the first bolt hole formed in the inner core part, the tip of the bolt is firmly screwed into the inner core part, thus enabling the inner core part and the outer core part to be securely fixed. Also, due to the first bolt hole extending in the axial direction of the inner core part from the end face of the inner core part, damage to the inner core part during manufacture or use of the reactor can be suppressed, compared with the case where the bolt hole extends at an angle to the axial direction. This is because the thickness of the first bolt hole from the inner circumferential surface to the circumferential surface of the inner core part is uniform in the axial direction of the inner core part, and thus sections where the thickness locally decreases are eliminated.

As one mode of the reactor, an inner diameter of the second bolt hole can be uniform in an axial direction of the second bolt hole.

Although a female thread portion corresponding to the male thread portion of the bolt may also be formed in the second bolt hole, the second bolt hole is preferably formed simply as a through hole, as shown in the above configuration. The second bolt hole, in the case of simply being a through hole, can be easily formed in the outer core part. For example, the second bolt hole can also be formed by performing hole machining on the outer core part, or the second bolt hole can also be formed with a mold for forming the outer core part.

As one mode of the reactor, the depth of the first bolt hole can be from greater than or equal to 0.1 times to less than or equal to 0.2 times an axial length of the inner core part.

By configuring the depth of the first bolt hole to be greater than or equal to 0.1 times the axial length, the coupling strength of the bolt and the inner core part can be sufficiently secured. Also, by configuring the depth of the first bolt hole to be less than or equal to 0.2 times the axial length, the inner core part is unlikely to be damaged by the machining performed when forming the first bolt hole, and a reduction in the strength of the inner core part due to the first bolt hole can be suppressed.

As one mode of the reactor according to the embodiment, the bolt can include a shaft part having a male thread portion and a head part formed at one end of the shaft part, and the resin included in the head part can be fused to the outer core part.

Because rotation of the head part becomes almost impossible due to the head part of the bolt fusing to the outer core part, the bolt is unlikely to loosen.

As one mode of the reactor, the bolt can be provided with a shaft part having a male thread portion and a head part formed at one end of the shaft part, the outer core part can include a recessed head housing part, the head housing part can be formed around an opening of the second bolt hole on an opposite side to the inner core part, and at least part of the head part of the bolt can be housed inside the head housing part.

By providing the head housing part in the outer core part, workers' hands or tools become less likely to hit the head part, at times such as when transporting the reactor or attaching the reactor to an installation target. As a result, rotation of the head part can be suppressed, and loosening of the bolt can be suppressed.

As one mode of the reactor, a shape of the head housing part as seen from the axial direction of the second bolt hole can be an imperfect circular shape, and the head part, having melted, can be deformed along an inner wall surface of the head housing part.

By configuring the contour shape of the opening of the head housing part to be an imperfect circular shape and melting the head part so as to follow the contour shape, the inner wall surface of the head housing part can be configured to serve as a physical rotation stopper of the head part.

As one mode of the reactor according to the embodiment, the inner core part can be constituted by a composite material formed by dispersing a soft magnetic powder in a resin.

The composite material contains resin, and thus has greater machinability than a powder molded body formed by compression molding a soft magnetic powder. Since the tip of the bolt is screw-coupled into the inner core part, the inner core part is preferably formed with a composite material that has excellent machinability.

In the reactor according to the embodiment, the inner core part and the outer core part are both integrated members, and thus the only place where there is room to interpose a gap member is between the inner core part and the outer core part, making it difficult to adjust the magnetic characteristics of the entire reactor. In contrast, adjusting the magnetic characteristics of the entire reactor is facilitated, by constituting at least the inner core part with a composite material. This is because the magnetic characteristics of a composite material are readily adjusted, by adjusting the content of soft magnetic powder.

As one mode of the reactor, the outer core part can be constituted by a powder molded body of a soft magnetic powder.

The content of soft magnetic powder in the powder molded body is easily raised, and, by raising the content of soft magnetic powder, the saturation magnetic flux density and relative permeability of the powder molded body are easily raised. In particular, if the inner core part is made of a composite material and the outer core part is made of a powder molded body, a reactor having exceptional magnetic characteristics can be obtained.

Hereinafter, embodiments of a reactor of the present disclosure will be described based on the drawings. The same reference numerals in the drawings indicate elements of the same name. Note that the present disclosure is not limited to the configurations shown in the embodiments and is defined by the claims, and all changes that come within the meaning and range of equivalency of the claims are intended to be embraced therein.

Embodiment 1

Figure 2:
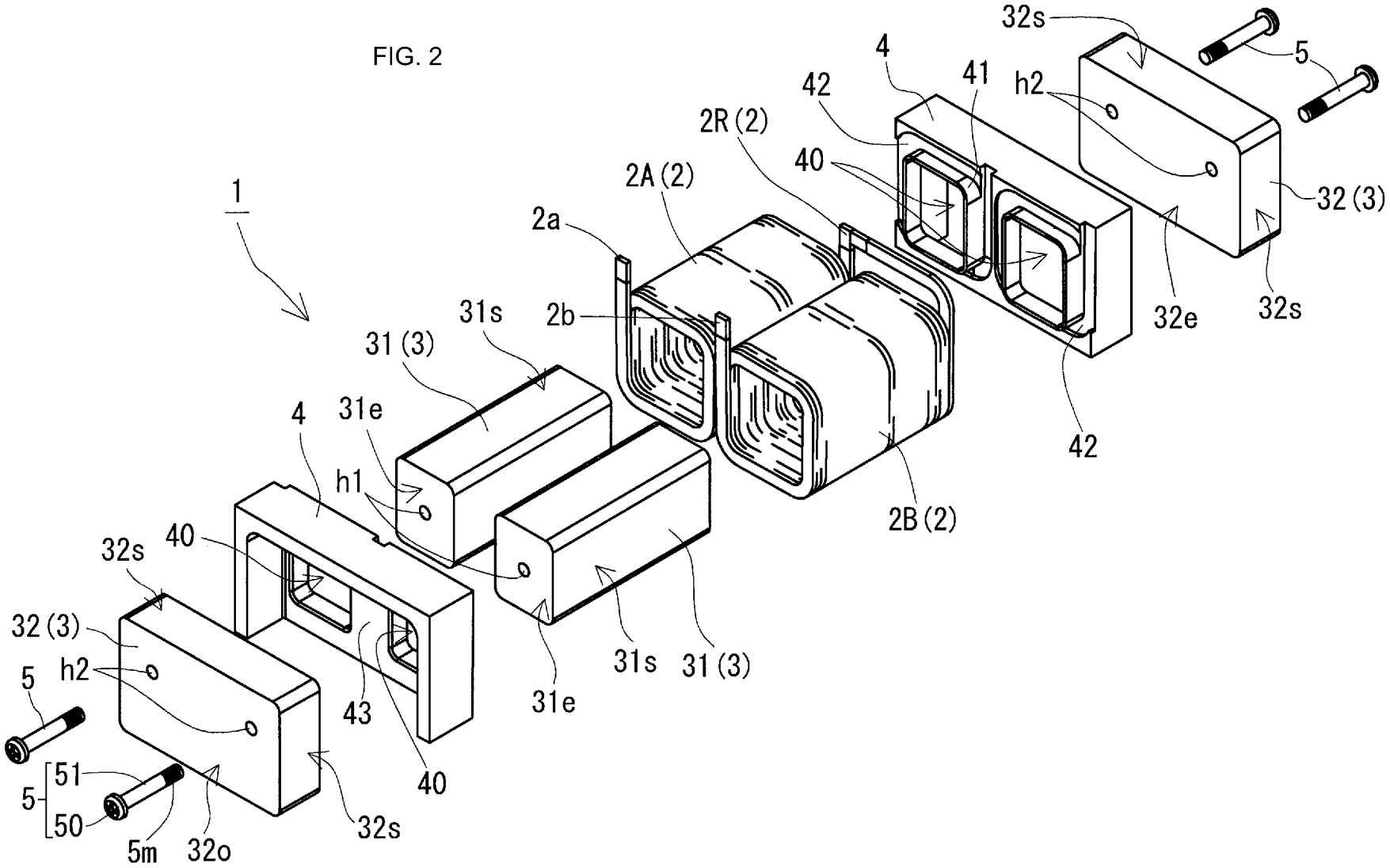
FIG. 2 is an exploded perspective view of the reactor in FIG. 1.
Figure 3:
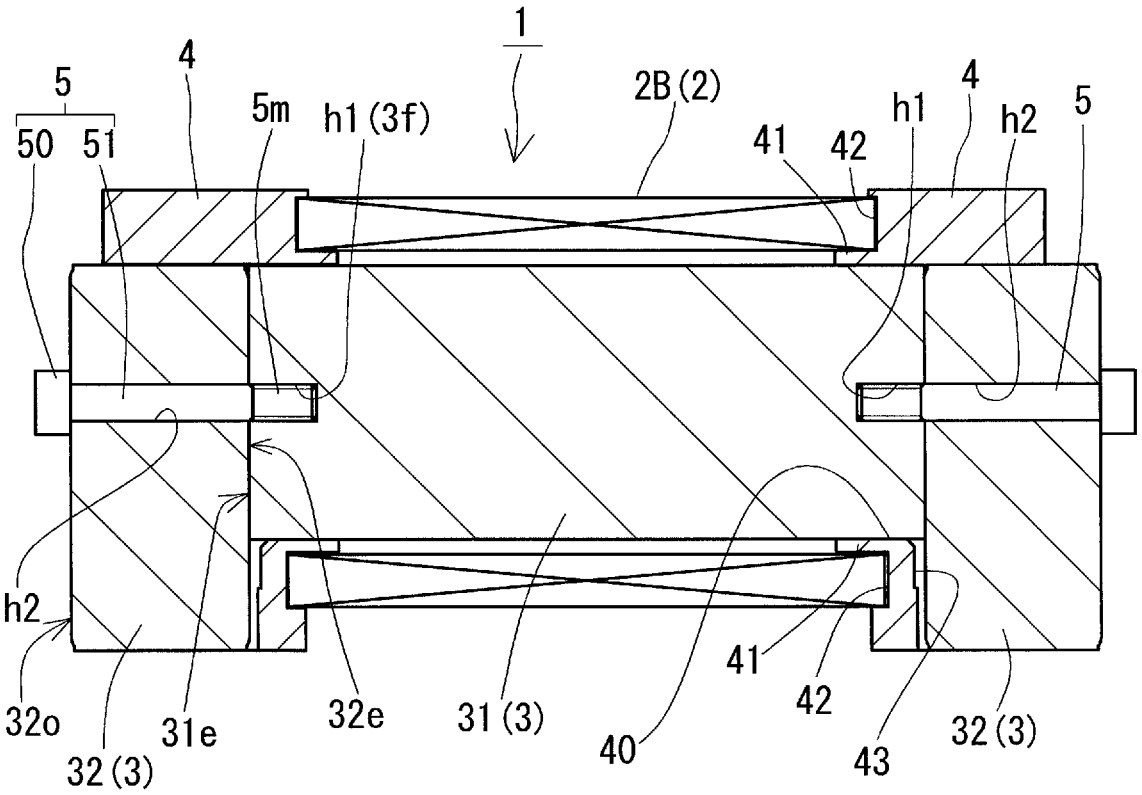
FIG. 3 is a longitudinal cross-sectional view of the reactor of Embodiment 1.

Embodiment 1 describes the configuration of a reactor 1 based on FIGS. 1 to 3. The reactor 1 shown in FIG. 1 is constituted by assembling together a coil 2, a magnetic core 3, and a holding member 4. The magnetic core 3 is provided with an inner core part 31 and an outer core part 32. As one of the features of this reactor 1, the inner core part 31 and the outer core part 32 are respectively an integrated member having an undivided structure, and the inner core part 31 is coupled to the outer core part 32 with a bolt 5 of a composite material. Hereinafter, each constituent element provided in the reactor 1 will be described in detail.

Coil

The coil 2 of the present embodiment is provided with a pair of wound parts 2A and 2B and a coupling part 2R that couples the wound parts 2A and 2B, as shown in FIG. 1. The wound parts 2A and 2B are each formed in a hollow tubular shape with the same number of turns and the same winding direction, and are aligned such that respective axial directions are parallel. In the present example, the coil 2 is manufactured by coupling the wound parts 2A and 2B manufactured using separate winding wires 2*w*, but the coil 2 can also be manufactured with a single winding wire 2*w*.

The wound parts 2A and 2B of the present embodiment are formed in a square-tubular shape. The square-tubular wound parts 2A and 2B are wound parts whose end face shape is a four-cornered shape (including a square shape) with rounded corners. Naturally, the wound parts 2A and 2B may be cylindrically formed. Cylindrical wound parts are wound parts whose end face shape is a closed curved shape (elliptical shape, perfect circular shape, racetrack shape, etc.).

The coil 2 including the wound parts 2A and 2B can be constituted by a coated wire provided with an insulation coating made of an insulating material on an outer periphery of a conductor such as a flat wire or round wire made of a conductive material such as copper, aluminum or magnesium or an alloy thereof. In the present embodiment, the wound parts 2A and 2B are each formed by edgewise winding a coated flat wire whose conductor is made of a copper flat wire (winding wire 2*w*) and whose insulation coating is made of enamel (typically, polyamide imide).

Both end portions 2*a* and 2*b* of the coil 2 extend from the wound parts 2A and 2B, and are connected to a terminal member which is not illustrated. At both end portions 2*a* and 2*b*, the insulation coating of enamel or the like has been removed. An external device such as a power source for supplying power to the coil 2 is connected via this terminal member.

Magnetic Core

The magnetic core 3 is provided with inner core parts 31 and 31 respectively disposed inside the wound part 2A and the wound part 2B, and outer core parts 32 and 32 forming a closed magnetic circuit with these inner core parts 31 and 31. The magnetic core 3 in the present example is a gapless structure in which a gap member is not disposed between the inner core parts 31 and the outer core parts 32, but may be a structure that is provided with a gap member.

Inner Core Part

The inner core part 31 is a portion of the magnetic core 3 that extends in the axial direction of the wound parts 2A and 2B of the coil 2. In the present example, both end portions of the portion of the magnetic core 3 that extends in the axial direction of the wound parts 2A and 2B protrude from the end faces of the wound parts 2A and 2B (FIG. 3). These protruding portions are also part of the inner core part 31. The end portions of the inner core part 31 that protrude from the wound parts 2A and 2B are inserted into a through hole 40 (FIGS. 2, 3) of the holding member 4 which will be described later.

The shape of the inner core part 31 is not particularly limited as long as the shape follows the internal shape of the wound part 2A (2B). The inner core part 31 in the present example is an approximately rectangular parallelepiped as shown in FIG. 2. This inner core part 31 is an integrated member having an undivided structure, this being one of the factors facilitating assembly of the reactor 1.

An end face 31*e* of the inner core part 31 in the axial direction abuts an inward surface 32*e* of the outer core part 32 which will be described later (FIG. 3). An adhesive may be interposed between the end face 31*e* and the inward surface 32*e*, but is not necessary. This is because the inner core part 31 and the outer core part 32 are mechanically coupled by the bolt 5, as will be discussed later. On the other hand, a peripheral surface 31*s* of the outer peripheral surface of the inner core part 31 excluding the end face 31*e* opposes the inner peripheral surface of the wound parts 2A and 2B, but is held at a distance from the inner peripheral surface out of contact with the inner peripheral surface. This is because the wound parts 2A and 2B both mechanically engage the holding member 4 which will be described later, and relative positions of the inner core part 31 and the wound parts 2A and 2B are determined.

The inner core part 31 in the present example is further provided with a first bolt hole h1, and a female thread portion 3*f* corresponding to a male thread portion 5*m* of the bolt 5 which will be discussed later is provided on the inner peripheral surface of the first bolt hole h1. The bolt 5 which will be discussed later is screw-coupled into this first bolt hole h1, and the inner core part 31 and the outer core part 32 are mechanically coupled by this screw-coupling.

The first bolt hole h1 in the present example is a bottomed hole (non-through hole) of a predetermined depth extending in the axial direction of the inner core part 31 from the end face 31*e* of the inner core part 31. Due to the first bolt hole h1 extending in the axial direction, the thickness from the inner peripheral surface of the first bolt hole h1 to the peripheral surface 31*s* of the inner core part 31 is uniform in the axial direction of the inner core part 31. As a result, sections where the thickness locally decreases are eliminated, thus enabling damage to the inner core part 31 during manufacture or use of the reactor 1 to be suppressed. Different from the present example, the first bolt hole h1 may be at an angle to the axial direction of the inner core part 31.

The depth of the first bolt hole h1 is preferably from greater than or equal to 0.1 times to less than or equal to 0.2 times the axial length of the inner core part 31. By configuring the depth of the first bolt hole h1 to be greater than or equal to 0.1 times the axial length of the inner core part 31, the coupling strength of the bolt 5 and the inner core part 31 can be sufficiently secured. Also, by configuring the depth of the first bolt hole h1 to be less than or equal to 0.2 times the axial length of the inner core part 31, the inner core part 31 is unlikely to be damaged by the machining performed when forming the first bolt hole h1, and a reduction in the strength of the inner core part 31 due to the first bolt hole h1 can be suppressed.

The first bolt hole h1 can be formed after forming a cylindrical hole having a uniform inner diameter (so-called loose hole), by threading the inner peripheral surface of the loose hole. The loose hole can be formed when molding the inner core part 31. For example, a core is disposed in the mold for producing the inner core part 31 at a location corresponding to the end face 31*e* of the inner core part 31, and the inner core part 31 is molded. Next, a loose hole is formed in the position where the core was disposed by extracting the core from the inner core part 31. The loose hole can also be formed by machining. In this case, a loose hole can be formed by machining a hole in the end face 31*e* with a drill or the like, after molding the inner core part 31. On the other hand, the female thread portion 3*f* can be formed by machining the inner peripheral surface of the loose hole with a tap or the like. In addition, in the case of forming the inner core part 31 with a composite material which will be discussed later, the first bolt hole h1 can also be formed by using a male threaded core. In this case, the first bolt hole h1 having the female thread portion 3*f* is formed by the core being removed from the inner core part 31 while being rotated.

Outer Core Part

The outer core part 32 is a portion of the magnetic core 3 disposed outside the wound parts 2A and 2B (FIG. 1). The shape of the outer core part 32 is not particularly limited as long as the shape joins the end portions of the pair of inner core parts 31 and 31. The outer core part 32 in the present example is a rectangular parallelepiped-shaped block body, but the shape in plan view may be approximately dome-shaped or U-shaped. This outer core part 32 is an integrated member having an undivided structure, this being one of the factors facilitating assembly of the reactor 1.

The outer core part 32, as shown in FIGS. 2 and 3, has the inward surface 32*e* opposing the end faces of the wound parts 2A and 2B of the coil 2, an outward surface 32*o* on the opposite side to the inward surface 32*e*, and a peripheral surface 32*s*. The inward surface 32*e* and the outward surface 32*o* are flat surfaces parallel to each other. An upper surface and a lower surface of the peripheral surface 32*s* are flat surfaces that are parallel to each other and orthogonal to the inward surface 32*e* and the outward surface 32*o*. The two side surfaces of the peripheral surface 32*s* are also flat surfaces that are parallel to each other and orthogonal to the inward surface 32*e* and the outward surface 32*o*.

The outer core part 32 in the present example is further provided with a second bolt hole h2 that extends coaxially to the first bolt hole h1 and passes through the outer core part 32. The second bolt hole h2 can be formed with a similar method to the first bolt hole h1. The second bolt holes h2 in the present example is a through hole with a uniform inner diameter in the axial direction of the second bolt hole h2, that is, a so-called loose hole. In other words, the female thread portion 3*f* is not formed on the inner peripheral surface of the second bolt hole h2. In consideration of the insertability of the bolt 5, the inner diameter of the second bolt hole h2 preferably is configured to be larger than the outer diameter (thread diameter) of the bolt 5. The size thereof is preferably from 0.1 mm to 0.2 mm inclusive.

Different from the present example, a female thread portion may also be formed on the inner peripheral surface of the second bolt hole h2. This enables the coupling of the inner core part 31 and the outer core part 32 by the bolt 5 to be further strengthened. The method of forming the female thread portion in the second bolt hole h2 is the same as that of the first bolt hole h1.

Materials, etc.

The inner core part 31 and the outer core part 32 can be constituted by a powder molded body formed by compression molding a base powder including a soft magnetic powder, or by a molded body of a composite material formed by dispersing a soft magnetic powder in a resin. In addition, core parts 31 and 32 can also be constituted as a hybrid core in which the outer periphery of a powder molded body is covered with a composite material. Also, the core parts 31 and 32 may be a molded body of a composite material in which a gap plate of alumina or the like is embedded, or may be a molded core in which a core piece is coupled to a gap plate and the outer periphery thereof is covered with a resin.

The powder molded body can be manufactured by filling a mold with a base powder and applying pressure thereto. Due to this manufacturing method, the content of soft magnetic powder can be readily increased in the case of a powder molded body. For example, the content of soft magnetic powder in the powder molded body can be increased to over 80 volume %, and further to 85 volume % or more. Thus, in the case of a powder molded body, core parts 31 and 32 whose saturation magnetic flux density and relative permeability are high are readily obtained. For example, the relative permeability ratio of the powder molded body can be set from 50 to 500 inclusive, and further from 200 to 500 inclusive.

The soft magnetic powder of the powder molded body is an aggregate of soft magnetic particles that are constituted by an iron group metal such as iron, an alloy thereof (Fe—Si alloy, Fe—Ni alloy, etc.), or the like. An insulation coating that is constituted by phosphate or the like may be formed on the surface of the soft magnetic particles. Also, the base powder may include a lubricant or the like.

On the other hand, the molded body of a composite material can be manufactured by filling a mold with a mixture of a soft magnetic powder and an unhardened resin, and hardening the resin. Due to this manufacturing method, the content of soft magnetic powder can be readily adjusted in the case of a composite material. For example, the content of soft magnetic powder in the composite material can set from 30 volume % to 80 volume % inclusive. From the viewpoint of improving saturation magnetic flux density and heat dissipation, the content of magnetic powder is preferably further set to 50 volume % or more, 60 volume % or more, or 70 volume % or more. Also, from the viewpoint of improving fluidity in the manufacturing process, the content of the magnetic powder is preferably set to 75 volume % or less. With the molded body of a composite material, the relative permeability thereof is readily reduced by adjusting the filling rate of the soft magnetic powder to a lower rate. For example, the relative permeability of the molded body of a composite material can be set from 5 to 50 inclusive, and further from 20 to 50 inclusive.

The same material that can be used with the powder molded body can be used for the soft magnetic powder of the composite material. On the other hand, a thermosetting resin, a thermoplastic resin, a room-temperature curing resin and a cold curing resin are given as examples of the resin included in the composite material. An unsaturated polyester resin, an epoxy resin, a urethane resin and a silicone resin are given as examples of the thermosetting resin. A polyphenylene sulfide resin, a polytetrafluoroethylene resin, a liquid crystal polymer, a polyamide resin such as nylon 6 or nylon 66, a polybutylene terephthalate resin and an acrylonitrile butadiene styrene resin are given as examples of the thermoplastic resin. In addition, a millable silicone rubber, a millable urethane rubber, a BMC (Bulk molding compound) in which calcium carbonate or glass fiber is mixed with an unsaturated polyester and the like can also be utilized. Heat dissipation is further improved when the abovementioned composite material contains a nonmagnetic and nonmetallic powder (filler) such as alumina or silica, in addition to the soft magnetic powder and the resin. The content of the nonmagnetic and nonmetallic powder may be set from 0.2 mass % to 20 mass % inclusive, and further from 0.3 mass % to 15 mass % inclusive, or from 0.5 mass % to 10 mass % inclusive.

Holding Member

The holding member 4 shown in FIGS. 2 and 3 is a member that is interposed between the end faces of the wound parts 2A and 2B of the coil 2 and the inward surface 32*e* of the outer core part 32 of the magnetic core 3, and holds the end faces of the wound parts 2A and 2B in the axial direction and the outer core part 32. The holding member 4, typically, is constituted by an insulating material such as a polyphenylene sulfide resin. The holding member 4 functions as an insulating member between the coil 2 and the magnetic core 3 and a positioning member of the inner core part 31 and the outer core part 32 with respect to the wound parts 2A and 2B. The two holding members 4 in the present example have the same shape. Thus, since the mold for manufacturing the holding member 4 can be commonly used, excellent productivity of the holding member 4 is achieved.

The holding member 4 is provided with a pair of through holes 40 and 40, a pair of core supporting parts 41, a pair of coil housing parts 42, and one core housing part 43. The through hole 40 passes through the holding member 4 in the thickness direction, and the end portion of the inner core part 31 is inserted into this through hole 40. The core supporting part 41 is a tubular piece that protrudes toward the inner core part 31 from the inner peripheral surface of each through hole 40, and supports the inner core part 31. The coil housing part 42 (FIG. 2) is a recess that follows the end face of the wound parts 2A and 2B, and is formed so as to surround the core supporting part 41, and the end face and a vicinity thereof are fitted therein. The core housing part 43 is formed due to part of the surface of the holding member 4 on the outer core part 32 side being recessed in the thickness direction, and the inward surface 32*e* of the outer core part 32 and a vicinity thereof are fitted therein. The end face 31*e* of the inner core part 31 fitted in the through hole 40 of the holding member 4 protrudes from the bottom surface of the core housing part 43 (FIG. 3). Thus, the end face 31*e* of the inner core part 31 abuts the inward surface 32*e* of the outer core part 32.

In addition, with the holding member 4 in the present example, a lower piece opposing the installation surface of a cooling base or the like is notched. The lower surface of the outer core part 32 that is fitted into the core housing part 43 of this holding member 4 is substantially flush with the lower end face of the holding member 4. According to this configuration, the magnetic circuit cross-sectional area of the outer core part 32 can be enlarged, without increasing the thickness of the outer core part 32 in the axial direction of the wound parts 2A and 2B, thus enabling the reactor 1 to be miniaturized. Also, the lower surface of the outer core part 32 is brought in contact with the installation surface of a cooling base or the like, thus enabling heat dissipation of the reactor 1 to be improved.

Bolt

The bolt 5 is a member that couples the inner core part 31 and the outer core part 32, due to passing through the outer core part 32 and the tip reaching the inner core part 31. The bolt 5 is provided with a head part 50 and a shaft part 51, and the male thread portion 5*m* is formed on the tip side of the shaft part 51. The male thread portion 5*m* is screw-coupled into the female thread portion 3*f* that is formed in the first bolt hole h1 of the inner core part 31, and the bolt 5 and the inner core part 31 are securely coupled. The outer core part 32 is configured to not separate from the inner core part 31, by being sandwiched by the head part 50 of the bolt 5 and the end face 31*e* of the inner core part 31. In this way, according to the configuration in the present example, the inner core part 31 and the outer core part 32 can be directly coupled without additional configuration apart from the bolt 5.

The bolt 5 is constituted by a molded body of a composite material. The composition of the composite material constituting the bolt 5 can be selected as appropriate. In the case where part of the magnetic core 3, such as the inner core part 31, for example, is constituted by a composite material, the composition of the composite material constituting the bolt 5 may be the same as or may be different from the composite material constituting the inner core part 31. If the bolt 5 and the inner core part 31 are configured to have the same composition, the occurrence of variability in the magnetic characteristics of the inner core part 31 including the bolt 5 can be suppressed.

In the case where the compositions of the bolt 5 and the inner core part 31 are differentiated, the resin content of the bolt 5 can be configured to be greater than the resin content of the inner core part 31 in consideration of the machinability of the bolt 5. In that case, the content of soft magnetic powder of the bolt 5 is preferably configured to be not too low in order to suppress deterioration in the magnetic characteristics of the bolt 5. For example, the resin content of the bolt 5 may be set from 50 volume % to 60 volume % inclusive, and the content of soft magnetic powder may be set from 40 volume % to 50 volume % inclusive. If the resin content of the bolt 5 increases, the machinability of the bolt 5 improves and formation of the male thread portion 5*m* in the bolt 5 is facilitated. Also, the effect of suppressing cracking, chipping and the like when screwing in the bolt 5 is also obtained. Also, the resin content of the bolt 5 may be configured to be less than the resin content of the inner core part 31, in consideration of the magnetic characteristics of the bolt 5. This configuration is, in other words, a configuration in which the content of soft magnetic powder of the bolt 5 is greater than the content of soft magnetic powder of the inner core part 31. Because the bolt 5 is located at the center of the magnetic circuit in the inner core part 31, the magnetic characteristics of the magnetic core 3 can be improved, by improving the magnetic characteristics of the bolt 5. For example, the resin content of the bolt 5 may be set from 30 volume % to 40 volume % inclusive, and the content of soft magnetic powder may be set from 60 volume % to 70 volume %.

Use Mode

The reactor 1 in the present example can be utilized as a constituent member of a power conversion device such as a bidirectional DC-DC converter mounted in an electrically powered vehicle such as a hybrid car, an electric car or a fuel cell vehicle. The reactor 1 in the present example can be used in a state of being immersed in a liquid refrigerant. The liquid refrigerant is not particularly limited, and ATF (Automatic Transmission Fluid) or the like can be utilized as the liquid refrigerant, in the case of utilizing the reactor 1 with a hybrid car. In addition, a fluorinated inert liquid such as Fluorinert (registered trademark), a fluorocarbon refrigerant such as HCFC-123 or HFC-134a, an alcohol refrigerant such as methanol or alcohol, a ketone refrigerant such as acetone or the like can also be utilized as the liquid refrigerant. In the reactor 1 in the present example, since the wound parts 2A and 2B are externally exposed, the wound parts 2A and 2B are brought in direct contact with the cooling medium in the case of cooling the reactor 1 with a cooling medium such as a liquid refrigerant, and thus the reactor 1 in the present example exhibits excellent heat dissipation.

Effects

The reactor 1 in the present example can be productively manufactured with a simple procedure. This is because the relative position of the inner core part 31 and the outer core part 32 is determined by only the mechanical engagement due to the bolt 5. The fact that the inner core part 31 and the outer core part 32 are both integrated members having an undivided structure is also one factor enabling the productivity of the reactor 1 to be improved. The inner core part 31 and the outer core part 32, being integrated members, are easy to handle, and the members that need positioning when coupling the inner core part 31 and the outer core part 32 can be kept to two members, namely, the inner core part 31 and the outer core part 32. Naturally, the reactor 1 of the present embodiment may be molded with a resin after coupling the inner core part 31 and the outer core part 32, or may be embedded in a case with a potting resin.

Also, with the reactor 1 in the present example, deterioration in magnetic characteristics that are required in the reactor 1 is unlikely to occur. This is because the bolt 5 that couples the inner core part 31 and the outer core part 32 is constituted by a composite material, and thus deterioration in the magnetic characteristics that are required in the magnetic core 3 of the reactor 1 is suppressed.

Embodiment 2

Figure 4:
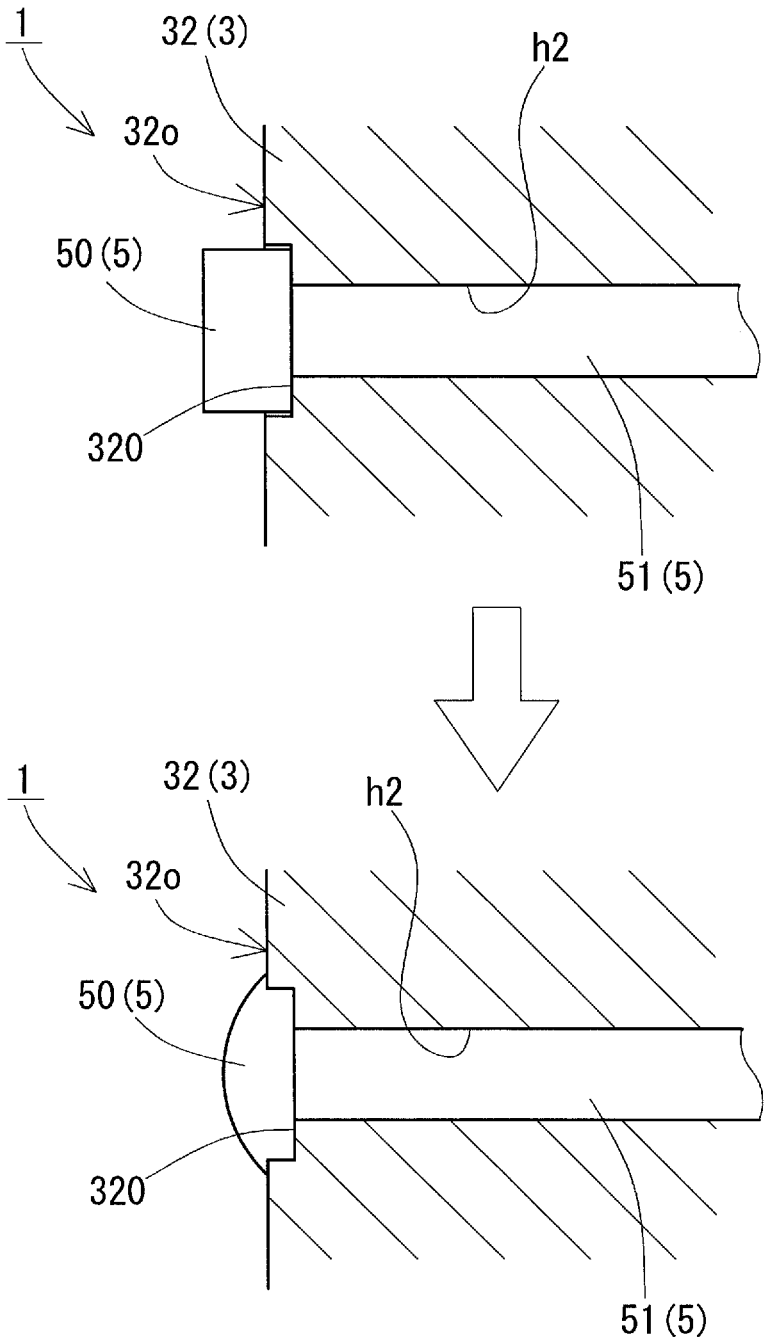
FIG. 4 is a partial longitudinal cross-sectional view of an outer core part of a reactor of Embodiment 2.

Embodiment 1 described a configuration in which the inner core part 31 and the outer core part 32 are simply coupled with the bolt 5. Alternatively, the head part 50 of the bolt 5 may be fused to the outer core part 32 utilizing the fact that the bolt 5 is constituted by a composite material. Hereinafter, the configuration in the present example will be described based on FIG. 4. FIG. 4 is a partial longitudinal cross-sectional view of a reactor 1 in which the outer core part 32 has been vertically sectioned at the position of a second bolt hole h2.

Different from Embodiment 1, in the present example, a head housing part 320 is formed in the outer core part 32. The head housing part 320 is a recess formed around the opening of the second bolt hole h2 on the opposite side to the inner core part 31, that is, a recess formed around the second bolt hole h2 in the outward surface 32*o*. The shape the head housing part 320 as seen from the axial direction of the second bolt hole h2 is circular. In assembling the magnetic core 3, in the present example, first, the bolt 5 is attached as shown in the upper half of FIG. 4, with part of the head part 50 housed in the head housing part 320. The head part 50 has a columnar shape having an outer diameter smaller than the inner diameter of the head housing part 320. Next, the head part 50 is melted as shown in the lower half of FIG. 4. In this configuration, the resin constituting the bolt 5 is a thermoplastic resin. The melted head part 50 deforms and hardens in an approximate dome shape spread over substantially the entirely of the head housing part 320. As a result, the head part 50 fuses to the outer core part 32 (in the present example, inner wall surface of the head housing part 320 described later). Because the head part 50 fused to the outer core part 32 does not rotate easily, loosening of the bolt 5 is effectively suppressed.

The temperature of parts other than the head part 50 such as the shaft part 51 and the outer core part 32 are preferably kept from becoming too hot, when melting the head part 50. For example, a heater is pressed against only the head part 50 and the resin included in the head part 50 is melted.

The depth of the head housing part 320 in the present example is smaller than the thickness of the head part 50 (length in the axial direction of the bolt 5). Also, in the present example, the volume of the head housing part 320 is smaller than the volume of the head part 50, resulting in part of the head part 50 being housed in the head housing part 320. According to such a configuration, the amount by which the head part 50 protrudes from the outward surface 32*o* of the outer core part 32 can be reduced. When the protruding amount is small, workers' hands or tools become less likely to hit the head part 50 at times such as when transporting the reactor 1 or installing the reactor 1 on an installation target. Thus, rotation of the head part 50 can be suppressed, and the bolt 5 is unlikely to loosen. Also, according to this configuration, the heater is unlikely to contact the outward surface 32*o*, when melting the head part 50. Thus, the problem of the outer core part 32 melting due to the heater can be suppressed.

Different from the present example, the depth of the head housing part 320 may be configured to be greater than or equal to the thickness of the head part 50. This results in the volume of the head housing part 320 being larger than the volume of the head part 50. In this case, by melting the head part 50, the entirety of the head part 50 is housed inside the head housing part 320. As a result, the melted and deformed head part 50 does not protrude from the outward surface 32*o* of the outer core part 32, thus enabling rotation of the head part 50 to be more reliably suppressed and enlargement of the outside dimensions of the reactor due to the bolt 5 to be suppressed. In addition, the depth of the head housing part 320 may be adjusted, such that the volume of the head housing part 320 is the same as the volume of the head part 50. In that case, the entire region of the head housing part 320 is filled by the melted and deformed head part 50, and a large step is not formed between the head part 50 and the outward surface 32*o* of the outer core part 32. Thus, damage to the outer core part 32 due to workers' hands or tools catching on the step can be suppressed.

Here, the head housing part 320 can be formed, regardless of whether the head part 50 is fused to the outer core part 32. However, it is preferable to form the head housing part 320 and fuse the head part 50 along the inner wall surface of the head housing part 320, as in the present example. This is because the fused area of the head part 50 and the outer core part 32 can thus be enlarged, compared with the case where the head housing part 320 is not provided.

Embodiment 3

Figure 5:
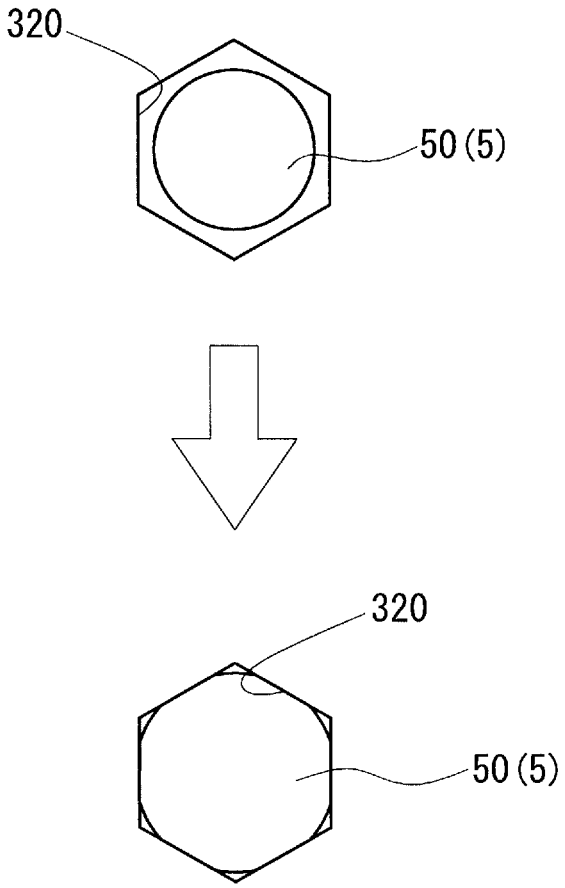
FIG. 5 is a schematic front view of a head housing part that is provided in an outer core part of a reactor of Embodiment 3.

Embodiment 3 describes a configuration in which the shape of the head housing part 320 described in Embodiment 2 is modified, based on FIG. 5.

FIG. 5 is a diagram of an outer core part 32 as seen from an outward surface 32*o* side. As shown in this diagram, the head housing part 320 that is formed in the outward surface 32*o* has an imperfect circular shape as seen from the axial direction of the second bolt hole h2. The contour shape of the opening of the head housing part 320 in the present example is a regular hexagon, but the contour shape can be configured as a polygonal shape or an elliptical shape.

As shown in the upper half of FIG. 5, the diameter of a circle inscribing the opening of the head housing part 320 is larger than the diameter of a circle circumscribing the outer peripheral contour line of the head part 50. This allows the head part 50 to be rotated when tightening the bolt 5.

When the head part 50 is housed in the abovementioned head housing part 320, the resin of the head part 50 is melted, similarly to Embodiment 2. The melted head part 50, as shown in the lower half of FIG. 5, spreads throughout the entirety of the head housing part 320 and deforms along the inner wall surface of the head housing part 320. As a result, the inner wall surface serves as a physical rotation stopper of the head part 50, effectively suppressing rotation of the head part 50.

The invention claimed is:

1. A reactor including a magnetic core and a coil having a wound part, the magnetic core having an inner core part disposed inside the wound part and an outer core part disposed outside the wound part, the reactor comprising:

a bolt coupling the inner core part and the outer core part, wherein the bolt is constituted by a composite material formed by dispersing a soft magnetic powder in a resin, and includes a shaft part passing through the outer core part, the shaft part includes a tip reaching the inner core part, and the inner core part and the outer core part are respectively an integrated member having an undivided structure.

2. The reactor according to claim 1, wherein the inner core part has a first bolt hole of a predetermined depth extending in an axial direction of the inner core part from an end face thereof, the outer core part has a second bolt hole extending coaxially with the first bolt hole and passing through the outer core part, and the inner peripheral surface of the first bolt hole is provided with a female thread portion corresponding to a male thread portion of the bolt.

3. The reactor according to claim 2, wherein an inner diameter of the second bolt hole is uniform in an axial direction of the second bolt hole.

4. The reactor according to claim 2, wherein the depth of the first bolt hole is from greater than or equal to 0.1 times to less than or equal to 0.2 times an axial length of the inner core part.

5. The reactor according to claim 1, wherein the bolt includes a shaft part having a male thread portion and a head part formed at one end of the shaft part, and the resin included in the head part is fused to the outer core part.

6. The reactor according to claim 2, wherein the bolt is provided with a shaft part having a male thread portion and a head part formed at one end of the shaft part, the outer core part includes a recessed head housing part, the head housing part is formed around an opening of the second bolt hole on an opposite side to the inner core part, and at least part of the head part of the bolt is housed inside the head housing part.

7. The reactor according to claim 6, wherein a shape of the head housing part as seen from the axial direction of the second bolt hole is an imperfect circular shape, and the head part, having melted, is deformed along an inner wall surface of the head housing part.

8. The reactor according to claim 1, wherein the inner core part is constituted by a composite material formed by dispersing a soft magnetic powder in a resin.

9. The reactor according to claim 1, wherein the outer core part is constituted by a powder molded body of a soft magnetic powder.

* * * * *